US008567331B2

(12) United States Patent
O'Brien

(10) Patent No.: US 8,567,331 B2
(45) Date of Patent: Oct. 29, 2013

(54) RUDDER ROLL STABILIZATION BY NONLINEAR DYNAMIC COMPENSATION

(75) Inventor: John F. O'Brien, Laramie, WY (US)

(73) Assignee: University of Wyoming, Laramie, WY (US)

( * ) Notice: Subject to any disclaimer, the term of this patent is extended or adjusted under 35 U.S.C. 154(b) by 578 days.

(21) Appl. No.: 12/636,260

(22) Filed: Dec. 11, 2009

(65) Prior Publication Data

US 2010/0147204 A1 Jun. 17, 2010

Related U.S. Application Data

(60) Provisional application No. 61/121,700, filed on Dec. 11, 2008.

(51) Int. Cl.
*B63B 43/04* (2006.01)
*B63H 25/06* (2006.01)

(52) U.S. Cl.
USPC ..... 114/122; 701/11; 701/21; 701/36

(58) Field of Classification Search
USPC ..... 701/11, 13–16, 35, 36, 21; 114/10, 122, 114/144 RE, 151, 126
See application file for complete search history.

(56) References Cited

U.S. PATENT DOCUMENTS 6,236,914 B1 * 5/2001 Kaloust ..... 701/11
2002/0014194 A1 * 2/2002 McKenney et al. ..... 114/144 R

OTHER PUBLICATIONS

O'Brien, John F., High-Order Control with Nonlinear Compensation for Rudder Roll Stabilization, Dec. 2007, Proceedings of the American Society of Naval Engineers Automation and Control Symposium.*

O'Brien, John F., "High-Order Control with Nonlinear Compensation for Rudder Roll Stabilization," Proceedings of the American Society of Naval Engineers Automation and Control Symposium, Biloxi, MS, 2007.

O'Brien, John F., "Multi-path Nonlinear Dynamic Compensation for Rudder Roll Stabilization," Control Engineering Practice 17(12), 1405-1414, 2009.

* cited by examiner

*Primary Examiner* — Helal A Algahaim
*Assistant Examiner* — Rodney P King
(74) *Attorney, Agent, or Firm* — Samuel M. Freund; Cochran Freund & Young LLC

(57) ABSTRACT

A method for rudder roll stabilization having two-feedback-path nonlinear dynamic compensation (NDC) is described. The high-order, Nyquist-stable control system having NDC hereof is absolutely stable and will provide a 20%-40% improvement in performance over existing roll reduction designs when lower performance steering mechanisms are employed, and is superior to linear controllers. That is, the present invention will be effective rudder roll stabilization in commercial vessels having slower rudders as well as in vessels having steering machines representing the best performance currently available, such as military systems. Since no ship hardware modifications are required, the present roll control technology will be able to be economically implemented.

7 Claims, 7 Drawing Sheets

RUDDER ROLL STABILIZATION BY NONLINEAR DYNAMIC COMPENSATION

RELATED CASES

The present application claims the benefit of provisional patent application Ser. No. 61/121,700 for "Rudder Roll Stabilization By Nonlinear Dynamic Compensation" by John F. O'Brien, filed on 11 Dec. 2008, which provisional application is hereby incorporated by reference herein for all that it discloses and teaches.

FIELD OF THE INVENTION

The present invention relates generally to roll stabilization of ships using a rudder for controlling heading while simultaneously reducing rolling motion and, more particularly, to the use of the vessel's rudder and a high-order, Nyquist-stable control system having two nonlinear dynamic compensation feedback paths for providing roll reduction without experiencing instability for such systems in the presence of either rudder angle or rudder movement rate saturation.

BACKGROUND OF THE INVENTION

Motion on a ship's roll axis can have several detrimental effects including cargo damage, reductions in crew effectiveness and increased pilot workload in helicopter landings. A maximum of 6° rms roll angle has been quantified for light manual work. Methods to attenuate this effect include the usage of fin stabilizers, bilge keels, anti-rolling tanks and rudder roll stabilizers (RRS). In contrast to other methods of roll motion reduction, RRS is attractive in that it does not require modifications to the vessel. Drawbacks of RRS have included the lack of performance at low speed, the need for a high speed rudder mechanism and the feedback limitations of the roll control loop. For an RRS system, the rudder is the actuator in a two output (roll and heading) system coupled by rudder-induced sway. Thus, the yaw and roll loops are designed with sufficient bandwidth separation, which may have a limiting effect on currently available roll control feedback. The roll plant is typically non-minimum phase, a characteristic in this application that increases the sensitivity of the closed loop system at low frequencies. The greatest limitation is the rudder mechanism itself, which is limited in maximum angle and angle rate. Several automated gain tuning algorithms to improve the performance of rudder roll stabilization controllers in saturation have been suggested, including the Automatic Gain Controller (AGC) and the Time-Varying Gain Reduction (TGR) algorithms. Model predictive control has also been applied to the rudder roll problem.

State of the art rudder roll stabilizers are typically proportional-derivative (PD) type, which provide marginal performance but retain stability when the rudder is saturated. A high-order rudder roll stabilizer with nonlinear dynamic compensation (HO+NDC) may provide substantially more roll reduction for ships having fast rudders (for example, 20°/s); however, rudder rate saturation may cause instability for such systems.

SUMMARY OF THE INVENTION

Accordingly, it is an object of the present invention to provide a method for obtaining roll reduction in vessels without the need for extra articulating surfaces or bilge keels.

Another object of the invention is to provide a method for obtaining roll reduction in vessels having lower performance steering mechanisms.

Still another object of the invention is to provide a method for obtaining roll reduction in vessels with lower performance steering mechanisms, while maintaining stability in the presence of either rudder angle or rudder movement rate saturation.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention, as embodied and broadly described herein, the method for rudder roll stabilization using multipath-feedback nonlinear dynamic compensation hereof includes the steps of: comparing the inverted ship's roll sensor output to the output of a nonlinear dynamic compensator; inputting the resulting signal to the roll compensator, $C_r(s)$; comparing the chosen heading to the ship's heading sensor output, defining thereby the heading error; inputting the heading error into the heading compensator, $C_y(s)$; adding the heading compensator and roll compensator outputs; inputting this result into the steering mechanism, thereby defining the rudder angle command; simultaneously inputting the rudder command input to the nonlinear dynamic compensator; whereby in the unsaturated condition, the outputs of summing junctions of the nonlinear dynamic compensator are zero, and the output of the nonlinear dynamic compensator is zero, and if the rudder is rate saturated, a rate-loop saturation element in the nonlinear dynamic compensator clips the output signal thereof; whereby the signal at the inverting input is different than the signal at the non-inverting input, the output of the summing junction is nonzero, and the nonlinear dynamic compensator output is this signal filtered by $C_{n1}(s)$; and whereby, if the rudder is angle saturated, the output is non-zero, and the nonlinear dynamic compensator output is this signal filtered by $C_{n3}(s)$ in cascade with the parallel filters $C_{n1}(s)$ and $C_{n2}(s)$, such that stability is provided for angle saturation which allows the simultaneous usage of $C_{n1}(s)$ in both paths of the NDC, and prevents unstable filter conditions due to inversion of non-minimum phase filters.

Benefits and advantages of the present invention include, but are not limited to, providing a method for obtaining roll reduction in vessels with lower performance steering mechanisms, while maintaining stability in the presence of either rudder angle or rudder movement rate saturation, using existing rudder actuation and roll sensing technology without the requirement of hardware modifications.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 1A:
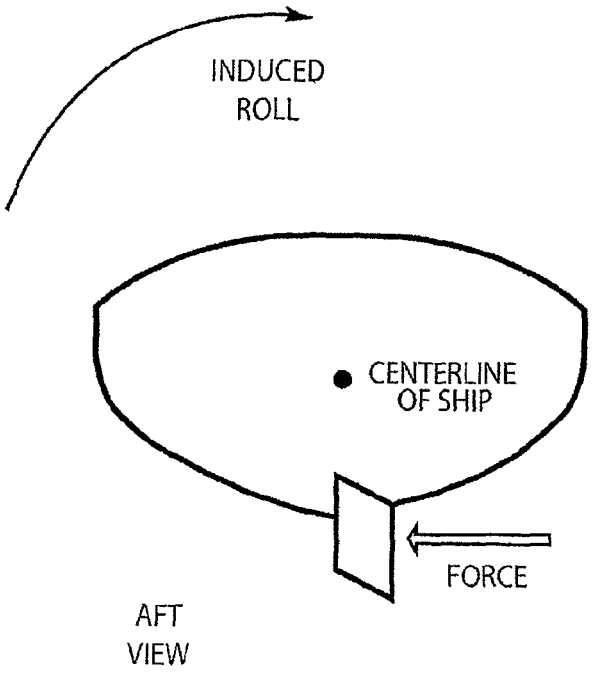
FIG. 1 is a schematic representation of the induced roll and induced yaw moments generated in a moving vessel when the rudder is deflected.

Briefly, the present invention includes a method for rudder roll stabilization having nonlinear dynamic compensation (NDC). A high-order, Nyquist-stable control system having NDC is shown to be absolutely stable and will provide a 20%-40% improvement in performance over existing roll reduction designs when lower performance steering mechanisms are employed, and is superior to linear controllers. The present invention is expected to be effective for rudder roll stabilization in commercial vessels having slower rudders as well as in vessels having steering machines representing the best performance currently available, such as military systems. Since no ship hardware modifications are required, the present roll control technology will be able to be economically implemented.

Rudder roll stabilizers use a vessel's rudder to control heading while simultaneously reducing rolling motion. As stated hereinabove, state-of-the-art rudder roll stabilizers are typically of the proportional-derivative (PD) type, which provides marginal performance, but retain stability when the rudder is saturated. Boosting feedback over a fixed frequency interval improves performance, but can threaten stability when a rudder saturates. Therefore, performance improvement cannot be achieved by linear control alone. An RRS strategy combining linear and nonlinear compensation and involving high-order loop shaping to provide large feedback over the frequency interval of interest, and a nonlinear dynamic compensator (NDC) to provide absolute stability when the system has a sector nonlinearity in the loop, is indicated. A high-order rudder controller with nonlinear dynamic compensation for rudder angle saturation has been shown to provide greater than 85% roll reduction to a ship with a high performance rudder in "High Order Rudder Roll Stabilization Controller with Nonlinear Compensation" by John F. O'Brien, Proceedings of the American Society of Naval Engineers Automation and Control Symposium, Biloxi, M S, 2007. While this controller has large feedback, it is absolutely stable only in angle saturation, and thus is applicable only for high performance steering machines. It is desirable that the effectiveness of such technology be shown for lower rudder bandwidth applications involving slower rudders that are implemented on larger vessels. Embodiments of the present invention using NDC with multiple feedback paths are shown to provide improved performance over previously published designs, and satisfy the condition of absolute stability in rudder angle and rate saturation.

Salient features of the present technology include: (a) Rudder roll stabilization without the need for additional articulating surfaces or bilge keels which is attractive for naval applications where such actuation represents a threat to robustness in the presence of underwater explosions; (b) The use of existing rudder actuation and roll sensing technology without hardware modifications which reduces the cost of implementing the present technology; (c) Rudder performance not used in current control schemes may be extracted by the present roll reduction method; and (d) The nonlinear dynamic compensator having multiple feedback paths, hereof, permits absolute stability in the presence of either rudder angle or rate saturation which directly applies to the limiting performance of a saturated rudder.

As stated hereinabove, a high-order (HO) rudder roll stabilizer having nonlinear dynamic compensation (HO+NDC) provides additional roll reduction for ships having fast rudders (for example, 20°/s), but rudder rate saturation can cause instability for such systems.

Embodiments of the present method (HO+Multi-path NDC) provide the superior performance of a high-order system (HO+NDC), but for slower rudder systems as well. Simulation results comparing these techniques for three rudder maximum speeds are illustrated in the TABLE, where 'X' indicates immediate rudder oscillation, and the number entries represent roll reduction percentage.

TABLE

| Rudder Rate | 20 deg/s | 15 deg/s | 10 deg/s |
|---|---|---|---|
| PD | 68 | 68.5 | 65 |
| HO + NDC | 89 | 47 | X |
| HO + Multi-path NDC | 87 | 84 | 72 |

Figure 1B:
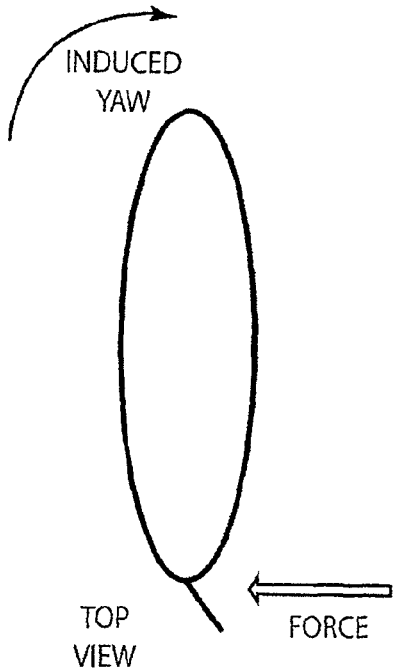

Reference will now be made in detail to the present embodiments of the invention, examples of which are illustrated in the accompanying drawings. In the Figures, similar or identical structure will be identified using the same reference characters. The control circuits set forth in FIGS. 2, 4, and 6-8, hereof, illustrate shorthand for control-theory representations which may be realized using mathematical equations. Numerical input to these equations may be evaluated using a computer such that feedback to a vessel's steering mechanism may be made in real time. Roll and yaw moments generated by rudder deflection for a moving vessel are illustrated in FIGS. 1A and 1B, respectively, where the combined yaw and heading motion controller ($C_y$ hereinbelow) may be a standard, low-gain system which is effective for cooperating with the roll controller of the present invention. Low frequency signals from the low-gain yaw/heading motion controller may be separated from those of a higher frequency roll controller ($C_r$ hereinbelow) on the basis of their frequency.

Roll and yaw disturbances by waves are modeled using a $2^{nd}$-order approximation: $\omega_0(s)=h(s)\omega_t(s)$, where $\omega_t(s)$ is Gaussian white noise. The filter is $$h(s) = \frac{K_\omega s}{s^2 + 2\zeta_0\omega_0 s + \omega_0^2},$$

where $\omega_0$, $\zeta_0$ and $K_\omega$ are the dominant wave frequency, the damping coefficient and the wave strength coefficient, respectively. The efficacy of a roll stabilizer design may be demonstrated by computer simulations. Three RRS designs were compared: low-order (PD), Nyquist-stable control with angle saturation NDC, and Nyquist-stable control with multi-path NDC. The PD heading controller described below in FIG. 6 was used in conjunction with all three RRS systems. Three rudder rate limits were considered: 20°/s, 15°/s, and 10°/s. The wave model above was employed using $K_\omega$=2.0, $\omega_0$=0.3, 0.5, 0.7, and 0.9 rad/s and $\zeta_0$=0.1. A quantitative measure of the relative performance is provided by the Roll Reduction $$\text{Percentage} = \frac{AP - RRCS}{AP} \times 100,$$

where AP is the standard deviation of roll rate with the heading controller on, RRS off, and RRCS is the standard deviation of roll rate with both the heading and RRS on. The TABLE shows the roll reductions for the PD controller, high order controller with rudder angle NDC only (HO+NDC), and high-order controller with multipath NDC (HO +multi-path NDC). The multi-path NDC system provides superior performance as low as 10°/s with the exception of a slight inferiority to HO+NDC with the fastest rudder. The enhanced performance is the result of large feedback in the linear condition, and a smooth transition to a less aggressive loop shape in either rudder angle or rate saturation. The roll controller is aggressive because of the magnitude of the applied feedback (~60 dB). Roll controllers with comparable bandwidths typically have about 100 times less feedback (less roll reduction). The difficulty with such aggressiveness is a lack of robustness and sensitivity to saturation. By contrast, the multi-path NDC provides high performance in the small signal condition, and stability in the large signal condition. The high-order controller with a single NDC feedback path (HO+NDC) is prone to oscillations triggered by rudder rate saturations that substantially reduce roll reduction. This characteristic is increasingly problematic as rudder speeds decrease.

Three designs were considered for the new roll stabilization controller. First the wave disturbance spectrum is concentrated in the decade from 0.1-1 rad/s. This, plus the fact that the actuator is not very effective in frequencies higher than 1 rad/s, suggests that the maximum available feedback (defined as the magnitude of 1+T(s), where T(s) is the return ratio) should be applied in this interval. Second, the coupled yaw and roll plants require frequency separation between the heading and roll stabilization controllers. The roll controller will be designed to cross 0 dB at ≥0.2 rad/s, which is the best case scenario. The third consideration is the non-minimum phase zero in the roll plant. It is fortunate that this zero is two octaves lower in frequency than the minimum first crossover frequency, as its phase contribution is only about 105° at 0.2 rad/s.

An $8^{th}$-order roll stabilizing controller was designed with these three issues taken into consideration. The fact that $C_r$ is $8^{th}$ order is a consequence of the particular dynamics of the ship. The order may vary for different ships since different roll mode frequencies may either increase or decrease the amount of available feedback which affects the compensator order. There also may be other modes related to bunker slosh, anti-roll tanks, and the like, that will require different compensation. However, the architecture of the multi-path NDC described hereinbelow has general applicability. Loop shaping is used to provide large feedback over the interval 0.1-1 rad/s. The gain zeros and poles for the compensator $C_r$ are K=79433, $s_z$=(0, −0.6000±1.3748i, −0.1800±0.2400i, −0.5000), and $s_p$=(−0.05, −2.400±3.624i, −0.6000±0.8000i, 0.0050±0.7000i, −100). The low frequency poles and zeros are spaced for a more aggressive roll-up/roll-off than is available with low-order compensation. A lead is applied to boost the phase at the second crossover. A simple pole observed at 100 rad/s reduces loop gain at high frequency and provides a strictly proper compensator transfer function. A zero at the origin provides a bandpass return ratio for the RRS controller.

Figure 2:
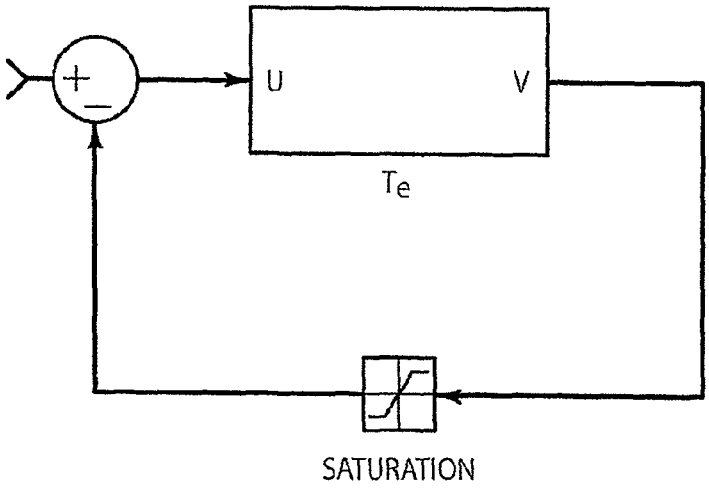
FIG. 2 is a control diagram showing the feedback connection of rudder saturation and the equivalent return ratio.
Figure 3:
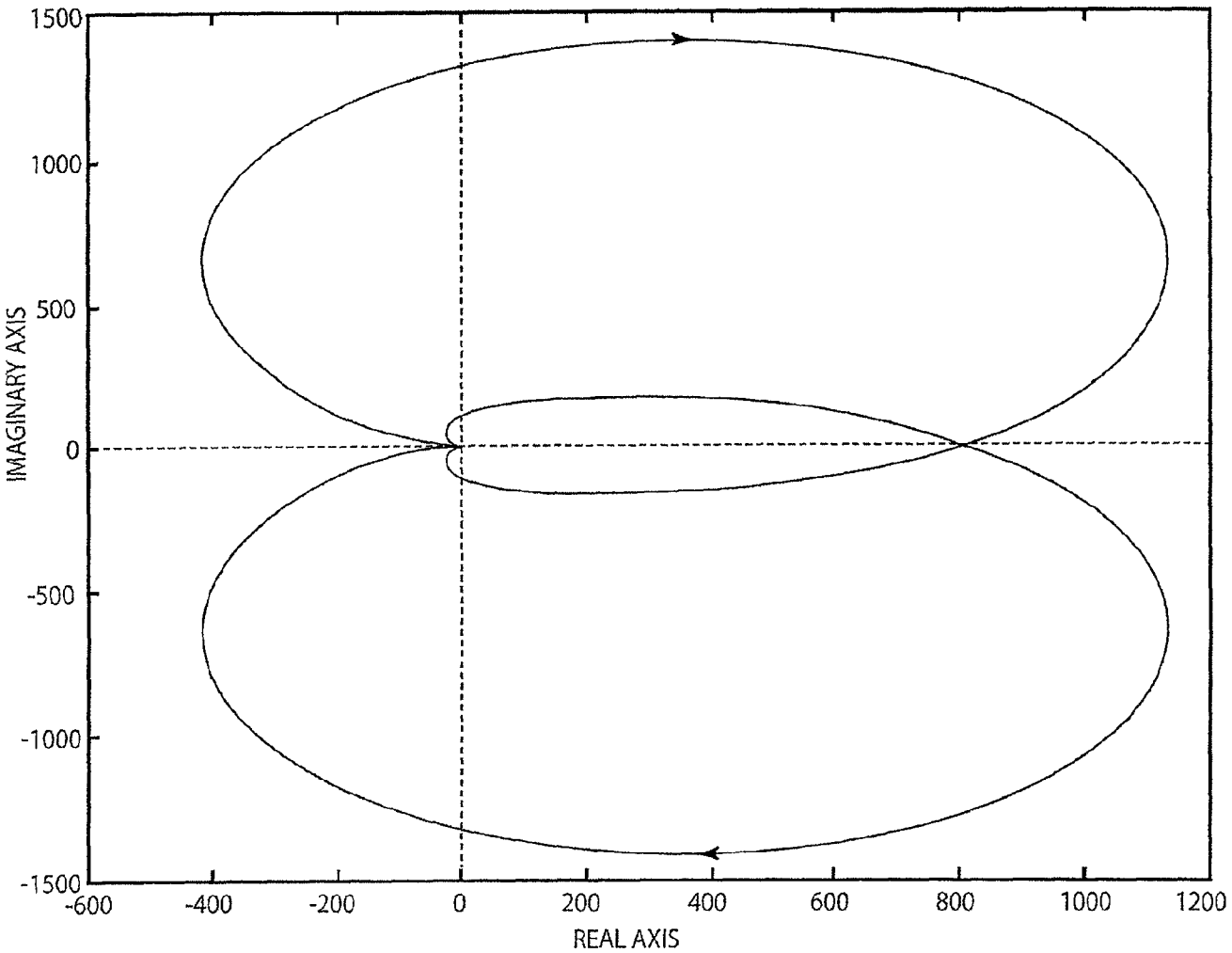
FIG. 3 is a Nyquist plot for the high-order rudder roll stabilizer return ratio control diagram shown in FIG. 2 hereof.

If a nonlinear element ψ(t, v) satisfies the sector condition and the system can be expressed as a feedback connection of the element and a linear system $T_e$ (equivalent feedback representation) as shown in FIG. 2, where u and v are input and output variables for the system $T_e$, respectively, v being the input to the saturation that is used in the sector inequality condition set forth hereinbelow, then the Popov criterion may be used to assess the absolute stability (AS) of the system (origin is asymptotically stable for all nonlinearities in the sector). This is a sufficient condition only. The saturation nonlinearity satisfies the sector condition $0 \le v\psi(v) \le v^2$ for all time, where v is an independent variable in the inequality, and an input to the nonlinear blocks of the NDC. The Circle Criterion, a specific case of the Popov Criterion, states if system $T_e(s)$, where s the Laplace variable, is Hurwitz, where the Hurwitz condition is satisfied if all the roots of the denominator polynomial of $T_e(s)$ have negative real parts, and the system $Z(s)=1+T_e(s)$ is strictly positive real, then the system is absolutely stable for this sector, and thus for the saturation nonlinearity. The second condition is equivalent to the Nyquist plot of $T_e(j\omega)$ lying to the right of the vertical line Re[s]=−1. The Nyquist plot of the $8^{th}$ order rudder roll stabilizer return ratio which is the open loop frequency response of the entire system, and is shown in FIG. 3. Clearly, the system does not satisfy the condition of AS in saturation. In addition, the controller is Nyquist-stable (the Nyquist plot crosses the negative real axis outside the unit circle and the closed loop system is stable). These systems lose stability when there is a reduction in loop gain.

Figure 4:
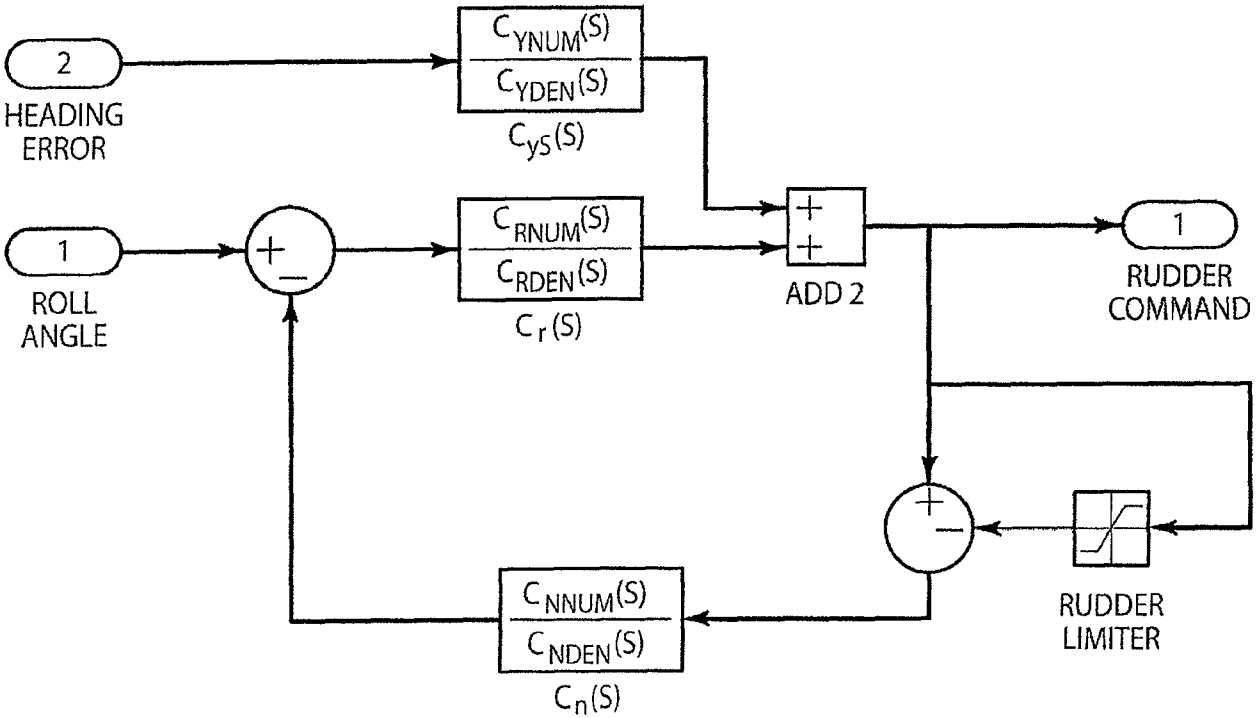
FIG. 4 shows a control diagram for a heading controller with rudder roll stabilization and nonlinear dynamic compensation.

Nonlinear, 8th-order compensation was applied to the linear RRS to provide AS in rudder angle saturation. The modified roll controller is shown in FIG. 4. A second system $C_n$ is connected in feedback to the nominal roll controller $C_r$ via a deadzone link. The deadzone (a nonlinearity that has a zero output for inputs less than a threshold value, and an affine linear function of the input for inputs larger than this threshold) 0 interval is the same as the linear interval of the actuator angle saturation. The return ratio for small signals is that shown in FIG. 3. For large signals (values where the output of the deadzone approaches that of the output of $C_r$), the feedback connection of $C_r$ and $C_n$ is the loop compensator $C_{rl}$ (a mathematical construct which is the equivalent transfer function of the feedback connections $C_r$ and $C_n$). Given the desired large signal compensator transfer function $C_{rl}$, $$C_n(s) = \frac{C_r(s) - C_{rl}(s)}{C_r(s)C_{rl}(s)}.$$

The large signal compensator is $C_{rl}$. The actuator and compensator saturations are identical, therefore the rudder angle saturation can be shown in feedback with the equivalent system.

$$T_e(s) = \frac{C_r(s)P_r(s) + C_y(s)P_y(s) - C_r(s)C_n(s)}{1 + C_r(s)C_n(s)},$$

where $C_r(s)$ is the PD heading control compensator, $$P_r = G_r \frac{1}{s+1}$$

and $$P_y = G_y \frac{1}{s+1}.$$

Figure 5:
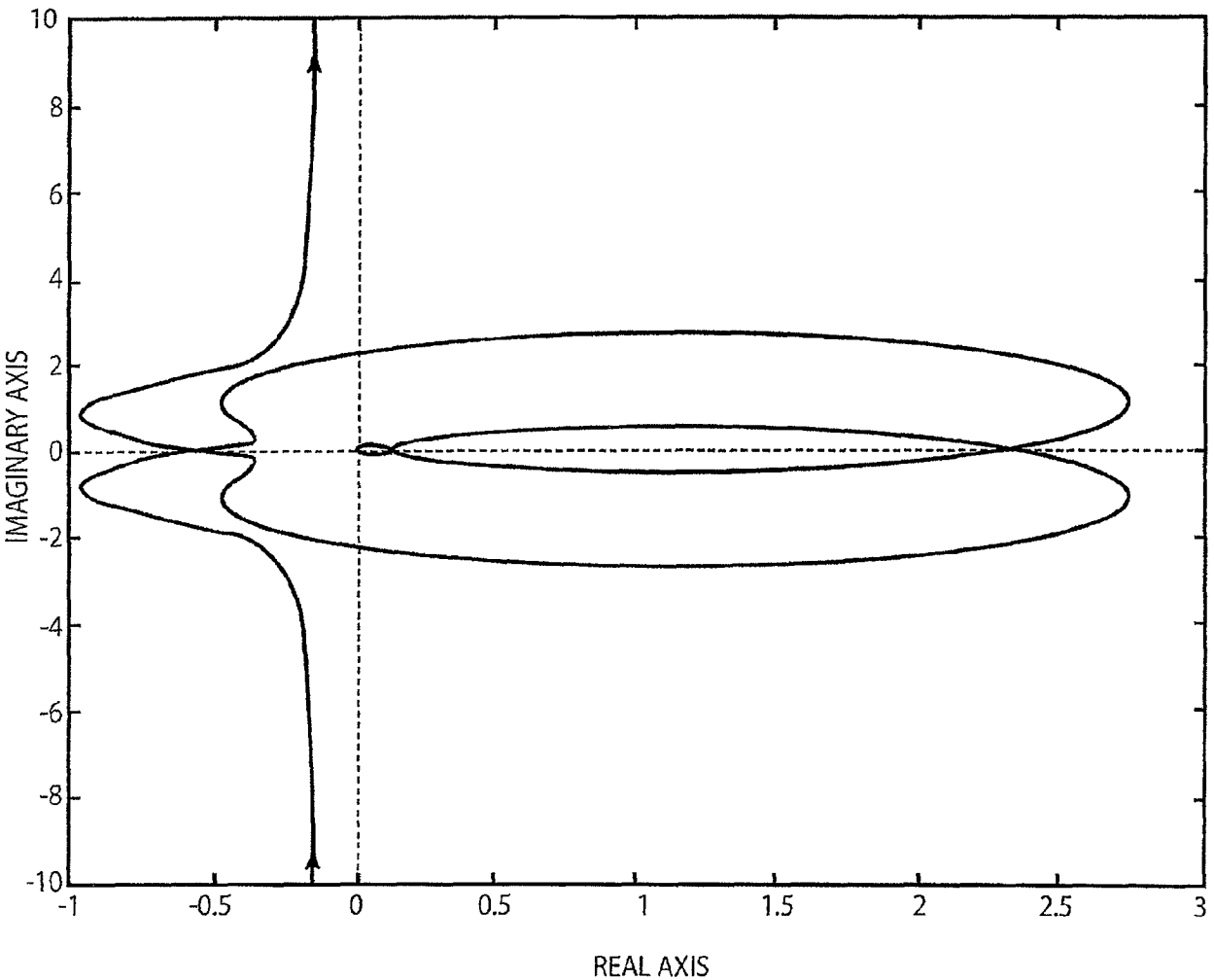
FIG. 5 is a Nyquist plot for the high-order rudder roll stabilization having nonlinear dynamic compensation and heading control shown in FIG. 4 hereof.

The Nyquist plot of $T_e(s)$ for the equivalent linear system response is shown in FIG. 5. The plot lies to the right of Re[s]=−1, and thus the controller satisfies the Circle Criterion.

Figure 6:
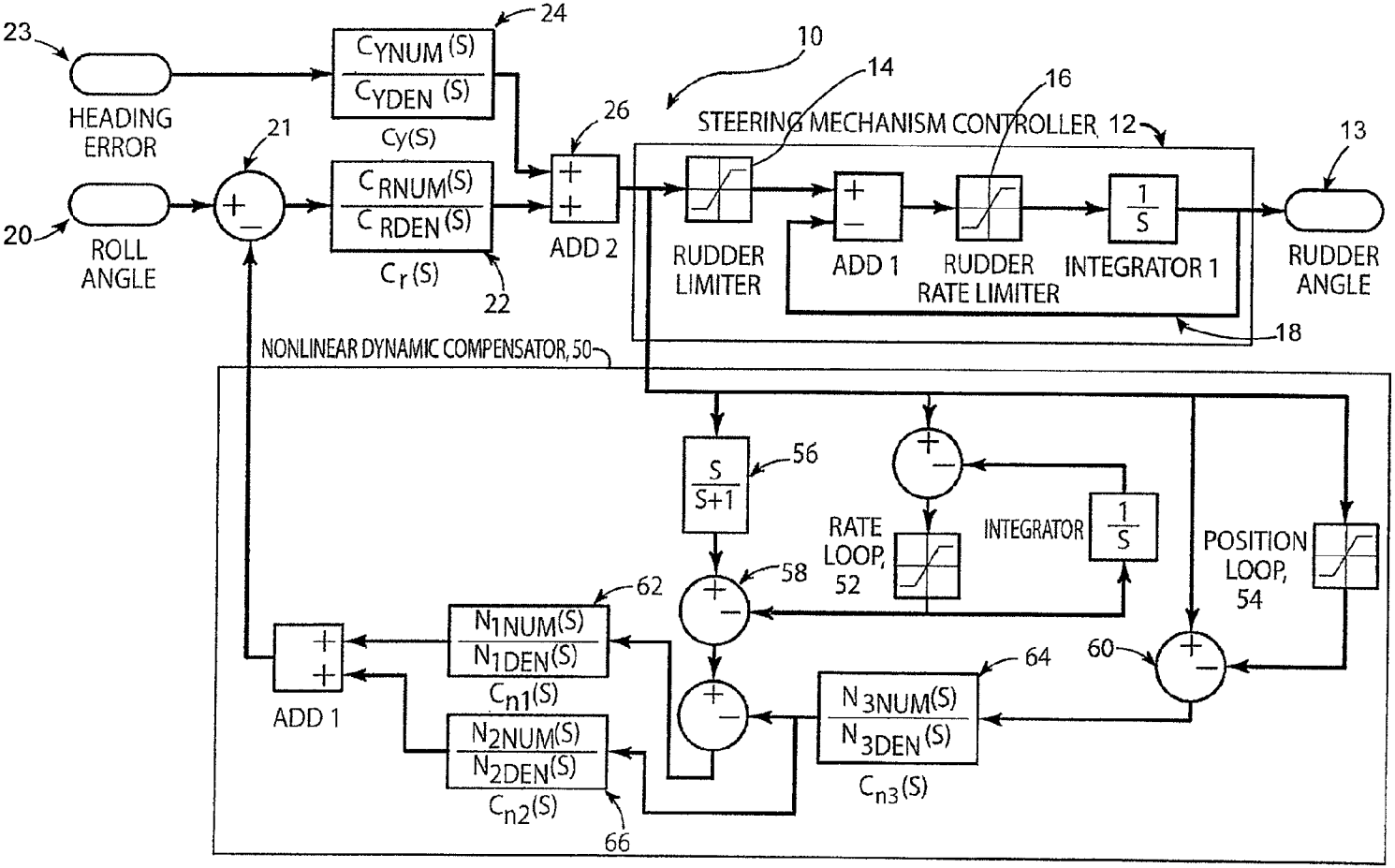
FIG. 6 shows a diagram of an embodiment of the heading control and rudder roll stabilization system of the present invention having multiple feedback path nonlinear dynamic compensation, and illustrating an embodiment of an existing steering control system cooperating with the nonlinear dynamic compensator hereof.
Figure 7:
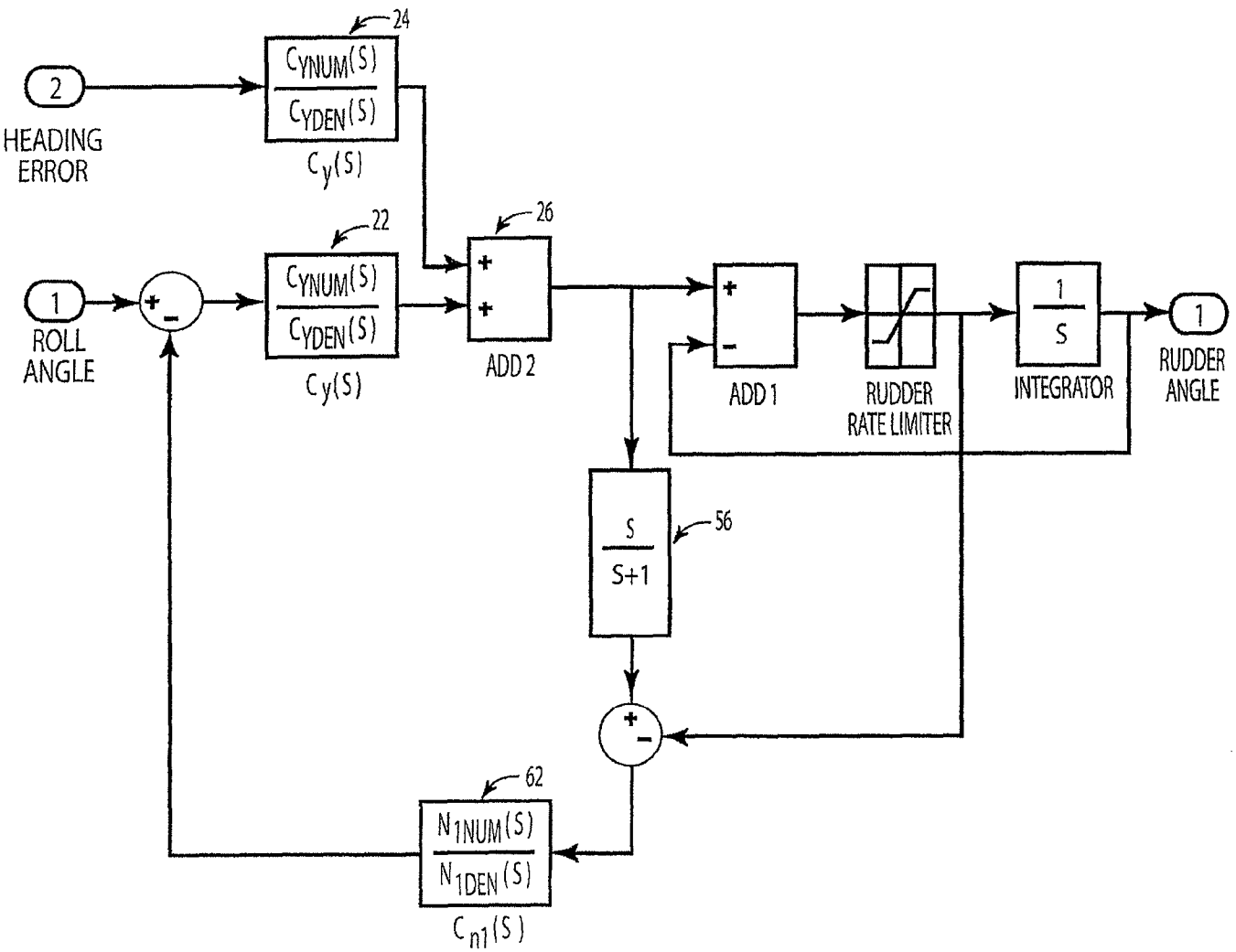
FIG. 7 shows the control diagram for the equivalent rudder roll stabilizer of the nonlinear dynamic compensator shown in FIG. 6 hereof in the rate saturation condition.

The high-order controller with NDC applied to the rudder roll stabilization controller is AS only if the rudder is not rate saturated. Rate saturation is often the situation in such applications, especially for rudder steering apparatus on larger vessels. The embodiment of the present control methodology illustrated as block diagrams in FIG. 6 provides AS for rudder angle or rudder rate saturation. In the situation where both states are saturated, absolute stability cannot be proven. However, this does not indicate that the system is unstable; rather, the Popov condition is a sufficient condition, and the stability margins for dual saturation are sufficiently large. The saturation links in the NDC called "Rate Loop" and "Position Loop" are identical to the saturations "rudder rate limiter" and "rudder limiter" in the rudder model, respectively. In rudder rate saturation (no angle saturation), an equivalent compensator is shown in FIG. 7 which, when connected to the steering plant, gives the structure shown in FIG. 2 and AS analysis of the system can be performed. The equivalent linear system connected to the saturation nonlinearity is $$T_{e_r}(s) = \frac{1 + G_r(s)C_r(s) + G_y(s)C_y(s) - C_r(s)C_{n_1}(s)\frac{s^2}{s+1}}{s\left(1 + C_r(s)C_{n_1}(s)\left(\frac{s}{s+1}\right)\right)}.$$

Transfer function $C_{n_1}$ is chosen such that $T_{e_r}=T_e$ (FIG. 5), and thus the system is AS for the rudder rate saturation.

Figure 8:
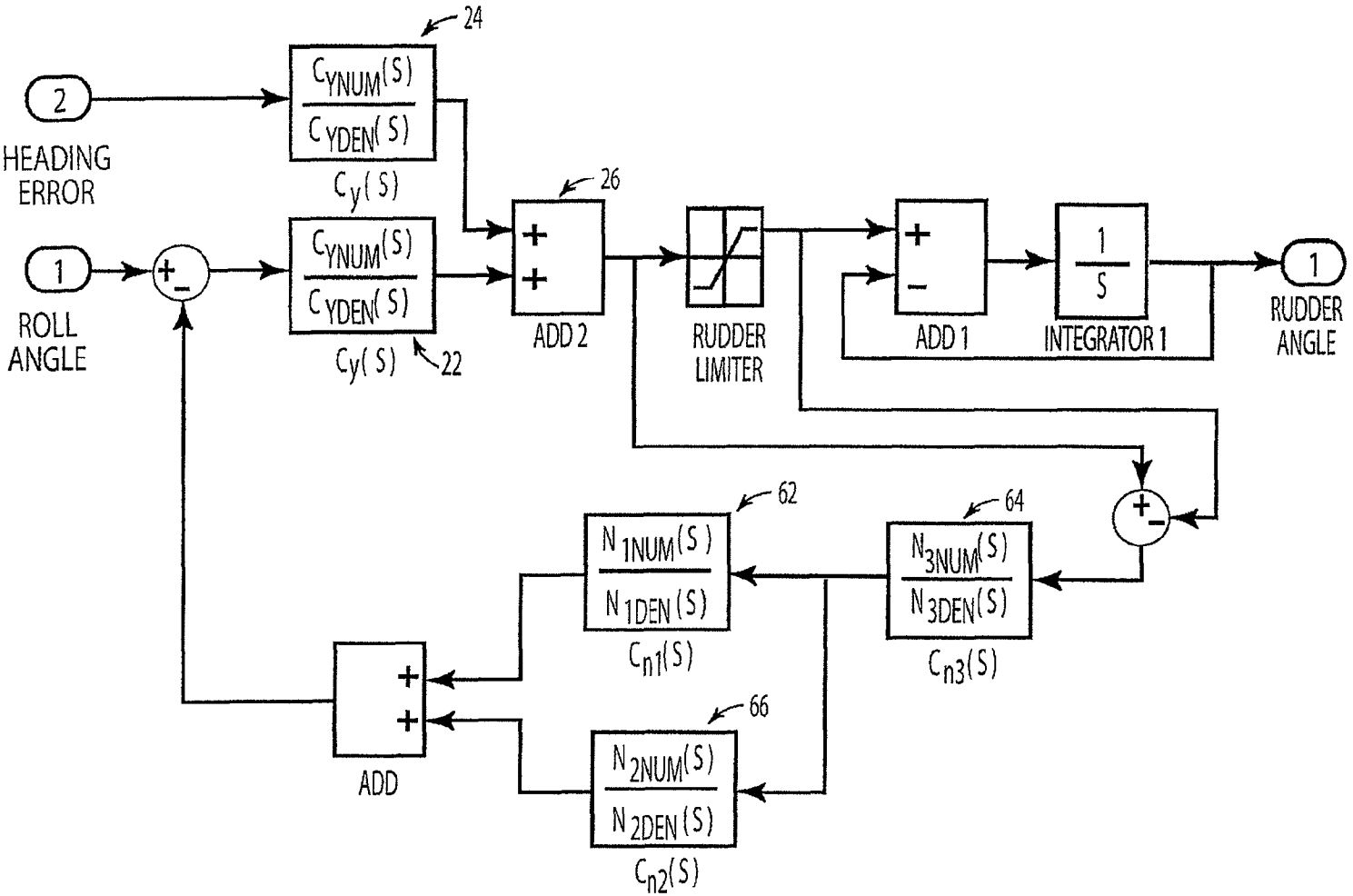
FIG. 8 shows the control diagram for the equivalent rudder roll stabilizer of the nonlinear dynamic compensator shown in FIG. 6 hereof in the angle saturation condition.

In rudder angle saturation (no rate saturation), an equivalent compensator is shown in FIG. 8. The saturation limits are identical to the rudder angle limits. This system connected to the plant yields the feedback connection to the saturation nonlinearity, and AS analysis is possible.

$$T_{e_a}(s) = \frac{P_r(s)C_r(s) + P_y(s)C_y(s) - N_c(s)C_r(s)}{1 + N_c(s)C_r(s)},$$

where $$P_r(s) = G_r(s)\frac{1}{s+1},$$

$$P_y(s) = G_y(s)\frac{1}{s+1},$$

and $$N_c = C_{n_3}(C_{n_1} + C_{n_2}) = C_n.$$

The structure $N_c$ is chosen because nonminimum phase zeros in $C_{n_1}$ make the filter $$\frac{C_n}{C_{n_1}}$$

unstable, thus a cascade of two filters is not feasible. With the selected $N_c$, $T_{e_Q}=T_e$ (FIG. 5) and The system is AS for the rudder saturation.

With the above-described multi-path NDC, the high-performance Nyquist-stable rudder roll stabilizer is AS for angle or rate saturations as well as for simultaneous angle and rate saturation, as is explained in more detail in "Multi-path Nonlinear Dynamic Compensation For Rudder Roll Stabilization" by John F. O'Brien, Control Engineering Practice 17(12), 1405-1414, December, 2009, the disclosure and teachings of which are hereby incorporated by reference herein. The present invention therefore permits the application of high-performance feedback systems for RRS appropriate for a wide range of vessels.

Having generally described the invention, the following EXAMPLE provides additional details thereof:

EXAMPLE

An embodiment of rudder roll stabilizer, 10, of the present invention is shown in FIG. 6 hereof. The blocks outside steering mechanism controller group, 12, are components of the heading controller/roll stabilizer. Steering mechanism 12 illustrates a simplified mathematical model of a rudder control loop. Rudder angle, 13, is limited in angle by limiter, 14, and the hydraulic steering machine is limited in rate by limiter, 16, the effects of which are modeled as saturations (rudder limiter and rudder rate limiter, respectively). These saturations limit performance and potentially threaten the stability of the feedback system. In the analysis set forth hereinabove, the angle limit was chosen to be 35°/s, and as stated, three rate limits were considered (10°/s, 15°/s, and 20°/s). The limiters are specifically designed using identified vessel dynamics and rudder characteristics. The following describes the function of the multi-feedback-path nonlinear dynamic compensator shown in FIG. 6.

The output of the ship's roll sensor, 20, is inverted and compared, 21, to the output of nonlinear dynamic compensator, 50, and the resultant signal is input to roll compensator, $C_r(s)$, 22. The chosen heading is compared to the ship's heading sensor (not shown in FIG. 6), generating heading error, 23, which is input to heading compensator, $C_y(s)$, 24. The heading compensator and roll compensator outputs are added, 26, and input to steering mechanism controller 12 which generates the rudder angle command directed to rudder 13. The output from adder 26 is simultaneously input to nonlinear dynamic compensator, 50. The saturation-linked rate loop, 52, and position loop, 54, are selected to match the rate and angle limits from rudder rate limiter 16 and rudder limiter 14 of the vessel's steering controller 12. In the unsaturated condition, the output of the system s/s+1, 56, is equal to the signal at the inverting input of summing junction, 58, and the signals at the inverting and non-inverting inputs of summing junction, 60, are the same. Thus, in the unsaturated condition, the outputs of summing junctions 58 and 60 are zero, and the output of NDC 50 is zero.

If the rudder is rate saturated, the rate loop saturation element in the NDC clips the signal output therefrom. The signal at the inverting input of summing junction 58 is now different than the signal at the non-inverting input. The output of summing junction 58 is nonzero, and the nonlinear dynamic compensator output is this signal filtered by $C_{n1}(s)$,

62. This filter is designed such that system stability is retained in the rate saturated condition. If the rudder is angle saturated, the output of summing junction 60, is non-zero, and the nonlinear dynamic compensator output is this signal filtered (clipped) by $C_{n3}(s)$, 64, in cascade with the parallel filters $C_{n1}(s)$ 62 and $C_{n2}(s)$, 66.

Some of the roots of the plant transfer function have positive real parts; therefore, some of the "n" filters in the NDC have zeros and a single filter approach would be unstable. Since the multi-path design of the present method requires a cancellation of such zeros, the present method and arrangement of the filters provides stability in angle saturation, allows the simultaneous usage of $C_{n1}(s)$ 62 in both paths of the NDC, and prevents unstable filter designs due to inversion of non-minimum phase filters.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for roll stabilization using feedback applied to the rudder of the ship, comprising the steps of:

obtaining output from a roll angle sensor;

inverting the output;

comparing the inverted output to the output of a multiple-feedback-path nonlinear dynamic compensator (NDC), producing thereby a first signal, wherein the NDC provides absolute stability for rudder angle and rudder rate saturation;

inputting the first signal to a roll compensator;

comparing a chosen heading to output from a heading sensor, producing thereby a heading error signal;

inputting the heading error signal into a heading compensator;

adding the outputs of the heading compensator and the roll compensator, producing thereby a second signal;

inputting the second signal into a rudder steering controller, thereby generating a rudder angle command signal; and simultaneously inputting the second signal into the NDC;

whereby, the output of the NDC is zero if the rudder angle command signal does not exceed either limitations to the rudder angle or to the rudder rate of movement.

2. The method for roll stabilization of claim 1, wherein the multiple-feedback path NDC comprises a two-feedback-path NDC.

3. The method for roll stabilization of claim 1, wherein the combination of the heading compensator and the roll compensator is Nyquist-stable.

4. The method for roll stabilization of claim 1, wherein the rudder steering controller includes a rudder rate limiter and a rudder limiter, and rate loop and position loop saturation feedback in the NDC are identical to the saturation in the rudder rate limiter and the saturation in the rudder limiter, respectively.

5. The method for roll stabilization of claim 1, wherein the NDC provides stability for simultaneous rudder angle and rudder rate saturation.

6. The method for roll stabilization of claim 1, further comprising the step of clipping the output signal of the NDC if the limitation on the rudder movement rate is exceeded.

7. The method for roll stabilization of claim 1, further comprising the step of clipping the output signal of the NDC if the limitation on the rudder angle is exceeded.

* * * * *